US005292044A

United States Patent [19]

Reimers

[11] Patent Number: 5,292,044

[45] Date of Patent: Mar. 8, 1994

[54] NON-SLIP CARRYING STRAP

[76] Inventor: Eric W. Reimers, 1235 Starwood, Missoula, Mont. 59802

[21] Appl. No.: 659,013

[22] Filed: Feb. 21, 1991

[51] Int. Cl.[5] ..... A41F 15/02; A45F 3/12

[52] U.S. Cl. ..... 224/264; 224/257

[58] Field of Search ..... 224/264, 202, 257, 258; 206/315.3; 150/107, 110

[56] References Cited

U.S. PATENT DOCUMENTS

| | | | |
|---|---|---|---|
| 1,055,077 | 3/1913 | Quirk | 224/264 |
| 3,882,914 | 5/1975 | Strutz | 224/264 |
| 4,125,904 | 11/1978 | Levine | 2/267 |
| 4,586,637 | 5/1986 | Lemel | 232/92 |
| 4,879,768 | 11/1989 | McClees et al. | 2/268 |
| 4,976,388 | 11/1990 | Coontz | 224/264 |
| 4,978,044 | 12/1990 | Silver | 224/257 |

FOREIGN PATENT DOCUMENTS

| | | | |
|---|---|---|---|
| 410573 | 4/1945 | Italy | 224/264 |
| 86924 | 2/1956 | Norway | 224/264 |
| 767014 | 1/1957 | United Kingdom | 224/264 |
| 1405623 | 9/1975 | United Kingdom | 224/264 |

*Primary Examiner*—Linda J. Sholl
*Attorney, Agent, or Firm*—Michael J. Hughes

[57] ABSTRACT

A non-slip pattern (14) is permanently secured to an engaging surface (32) which is adapted to engage a load supporting element such as a human shoulder. A non-slip carrying strap (10) is formed utilizing a strap pad (12) upon which the non-slip pattern (14) is secured. The pattern (14) consists of a plurality of elongated bar portions (40) formed of a liquid silicon rubber material (38). The bar portions (40) are arrayed in a grid (50) to inhibit sliding motion in any direction and the bar portions are formed to have a trapezoidal cross section, including apexes to enhance friction. The shoulder engaging surface (32) is a fabric including a back plane (46) of base fibers (44) from which upright fibers (48) extend, with the bar portions (40) being applied and curved so as to encompass the fibers. The primary usage is as a carrying strap (10) for a golf bag.

12 Claims, 2 Drawing Sheets

NON-SLIP CARRYING STRAP

TECHNICAL FIELD

This invention relates to straps for shoulder carrying of heavy objects and more particularly to a non-slip cushioning pattern incorporated into a carrying strap utilized on golf bags.

BACKGROUND ART

A typical golf bag is carried by the user by a strap which is placed on the shoulder. Although golf bags are typically provided with carrying handles, as well, the shoulder strap is the primary method by which the "walking" type of bag is transported about the course by the golfer.

One of the common problems faced by a golfer is the tendency of the strap pad to slip off the shoulder during the walking portion of the round. Another problem often faced by the golfer is the strap which tends to dig into the shoulder and cause discomfort. Attempts to solve one of the problems have, more often than not, exacerbated the other problem.

Various attempts have been made in the art to provide padded straps or comfortable straps for use on golf bags. A visit to any golf shop will indicate the profusion of foam pads, fur liners, cushioned straps and other attempts at increasing the golfer's comfort. Gone are the days when the golf bag strap was a narrow leather strap which dug into the shoulder but avoided any slippage. With the advent of the modern golfer's dependence on a large number of clubs and associated gadgets, the weight of the golf bag has increased to the extent that it is necessary to utilize some sort of 1 padding on the strap in order to avoid acute discomfort for many golfers.

Unfortunately, attempts to increase comfort often decrease the stability of the shoulder strap on the user's shoulder. For example, a fur or imitation fur covering on the bag strap tends to increase the amount by which the strap is free to slide on the shoulder. This results in a increased incidence of the bag slipping off the shoulder (or nearly slipping off), causing potential damage and discomfort to the golfer.

Although not specifically directed to the problem of golfers, the related problems of slippage and comfort in shoulder straps have been addressed in previous U.S. patents. For example, U.S. Pat. No. 4,125,904, issued to Shirley Levine, discloses a strap for a shoulder bag including both comfort padding and non-slip materials. Additionally, the non-slip strap pad of McClees et al., U.S. Pat. No. 4,879,768 also addresses this problem.

However, none of the efforts reflected in the prior art, either from a commercial standpoint or a patent standpoint, have solved the golfer's difficulties in comfortably carrying a relatively heavy golf bag on the shoulder without excess slippage. Furthermore, the golfer's carrying strap must also be easily removable and must result in no undue wear to or discoloration of the golfer's shirt. Because of all these requirements and problems, there exists substantial room for improvement in the golf bag carrying strap art.

SUMMARY OF THE INVENTION

Accordingly, it is an object of the present invention to provide a carrying strap for a golf bag which provides maximum comfort to the user's shoulder.

It is another object of the present invention to provide a golf bag shoulder strap which minimizes slippage along a golfer's shoulder, regardless of clothing material, while being easily removable when desired.

It is still another object of the present invention to provide a non-slip characteristic to a shoulder strap surface in a manner which results in a visually attractive pattern.

Yet another object of the present invention is to provide a long lasting and durable non-slip surface to the shoulder engaging portion of a golf bag shoulder strap.

The present invention is adapted primarily for utilization with golf bag shoulder straps. The invention further relates to a method of embedding and securing a non-slip pattern on the shoulder engaging surface of a padded strap. The applicability of the incorporation of the non-slip surface to the strap is useful in any of very great variety of applications, but is primarily aimed at the shoulder straps of golf carry bags.

Briefly, a preferred embodiment of the present invention is a golfer's shoulder strap wherein the shoulder engaging surface is formed of a comfortable material which promotes sliding of the material along a surface, such as a golfer's shoulder or clothing. A portion of the engaging surface is provided with a predetermined pattern of incorporated non-slip material by a process of incorporating a portion of the non-slip material directly into the fabric of the engaging surface itself so as to form a permanent bond. A portion of the non-slip material extends above the surface of the preferred velour material in order to provide a friction surface to inhibit sliding motion of the strap with respect to the shoulder. In the preferred embodiment, the non-slip material is liquid silicone rubber (LSR) material applied to the velour material by a heat molding process which permanently bonds it thereto.

An advantage of the present invention is that the non-slip surface may be combined with a comfort providing sliding surface without degradation of the base material.

Another advantage of the present invention is that the non-slip pattern is formed of a material which is, in itself, cushioning, thus avoiding any "hard" areas which might provide discomfort.

Yet another advantage of the present invention is that it may be combined with a strap member having substantial padding, without degrading the quality of non-slip protection provided.

It is still another advantage of the present invention is that the non-slip pattern provides excellent resistance to sliding friction while refraining from causing the contact with the user shoulder to be "sticky" with respect to vertical lifting.

It is yet another advantage of the present invention that the non-slip pattern may be applied in a manner which is attractive and may be adjusted to the user's specification.

Still another advantage of the present invention is that the non-slip material may be provided in a variety of colors and patterns so as to match or accentuate the material of the strap itself.

It is still a further advantage of the present invention that it is a permanent attachment process which minimizes the likelihood of degradation of the pattern over time and usage.

These and other objects and advantages of the present invention will become clear to those skilled in the art in view of the description of the best presently known mode of carrying out the invention and the industrial applicability of the preferred embodiment as described herein and as illustrated in the several figures of the drawing.

BEST MODE OF CARRYING OUT THE INVENTION

The present invention is a non-slip pattern shoulder strap adapted primarily for utilization with a golf bag. The invention is adapted for utilization with any of a wide variety of golf bags and is intended to provide comfort to the user's shoulder in carrying the golf bag on a round of golf, while minimizing the relative lateral slippage between the bag strap and the shoulder. The bag is particularly adapted for being easily removed from the shoulder by vertical lifting but being very resistant to sliding friction.

Figure 1:
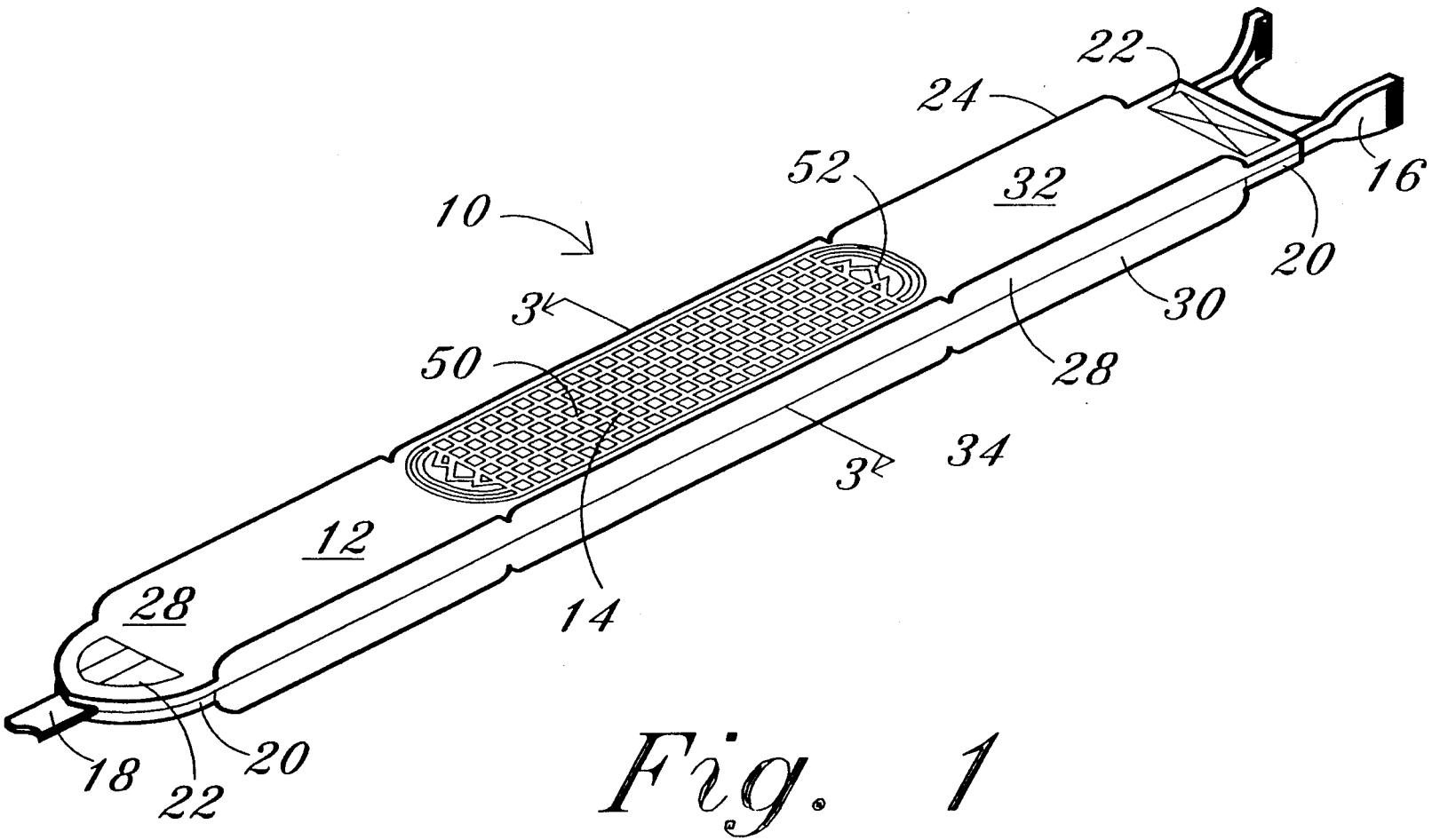
FIG. 1 is perspective view of a non-slip carrying strap for a golf bag, according to the present invention.

Referring now to FIG. 1 a non-slip shoulder carrying strap according to the present invention is illustrated in a perspective manner and designated by the general reference character 10. The non-slip carrying strap 19 is characterized by a large elongated central strap pad 12 having a non-slip pattern 14 formed thereon. One end of the strap pad 22 is connected to a bag yoke 16 while the other end is connected to a handle strap 18. In both cases the attachment is accomplished utilizing reinforcing patches 20 and heavy stitching 22. The bag yoke 16 will usually attach to the upper portion of a golf bag, ordinarily by virtue of another strap which extends around the top of the golf bag, as in the "ECLIPSE" model golf bag manufactured by Sun Mountain Sports, Inc. of Missoula, Mont. The handle strap 18 will extend to attach to the golf bag at a position along the spine of the bag, usually between the midpoint and the bottom of the bag.

Figure 3:
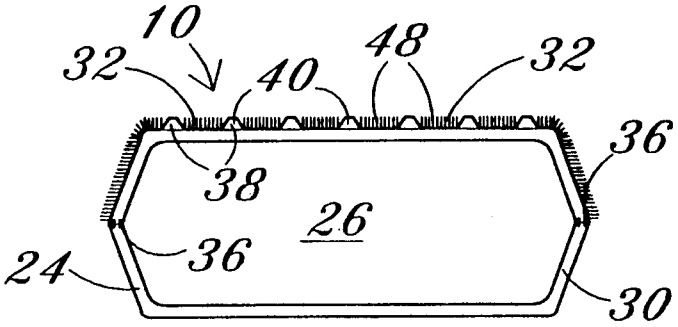
FIG. 3 is a partial cross sectional view, taken along line 3—3 of FIG. 1.

As is best seen in FIG. 3, the strap pad 12 includes a fabric pad shell 24 enclosing a cushion insert 26. The pad shell 24 includes an inner shell member 28 and a outer shell member 30. In this case, for the purpose of ease of presentation, the terms inner and outer are selected. It is understood that these terms refer to orientation with respect to the loop formed by the bag strap 10 and the golf bag (into which the user's arm and shoulder are placed) and not to any enclosure of the inner shell member 28 by any other member.

The outer shell member 30 is of a material selected for strength, durability and appearance but without respect to shoulder comfort since the surface of the outer shell 30 will not ordinarily contact the golfer's shoulder. On the other hand, the inner shell member 28 is the portion of the strap pad 12 which will ordinarily engage the golfer's shoulder. The inner shell member 28 is selected to provide a comfortable feel to the golfer. This is ordinarily accomplished by causing a shoulder engaging surface 32, being the outward facing surface of the inner shell member 28, to be a velour or other similar material.

As shown in FIG. 1, a pair of reinforcing rivets 34 extends through the cushion insert 26 from the inner shell member 28 to the outer shell member 30. These optional reinforcing rivets 34 serve a purpose of preventing any shifting of the cushion insert 26 during usage. Furthermore, the positioning of the reinforcing rivet 34 at the approximate ends of the non-slip pattern 14 also provides a natural bending position for the strap pad 12. That is, the strap pad 12 is more easily deformable at the vicinity of the reinforcing rivets 34 than at its other portions. In this manner, the natural bending of the non-slip carrying strap 10 will tend to center the non-slip pattern 14 on the user's shoulder.

The pad shell 24 is secured together about the cushion insert 26 by shell stitching 36 which secures the inner shell member 28 to the outer shell member 30. The shell stitching 36 is ordinarily accomplished prior to insertion of the cushion insert 26 and attachment of the reinforcing patches 20.

Figure 4:
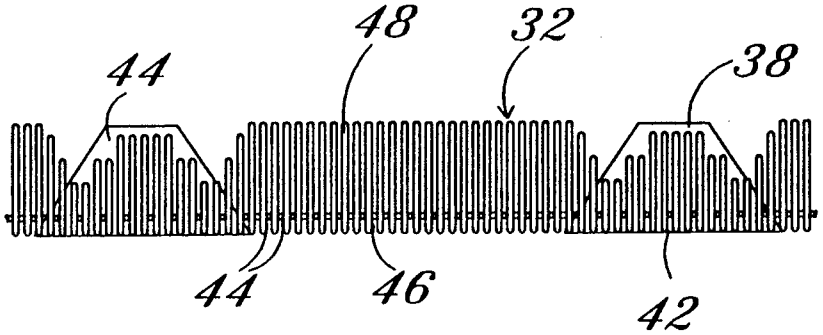
FIG. 4 is a fanciful detailed sectional view of a portion of FIG. 3.
Figure 2:
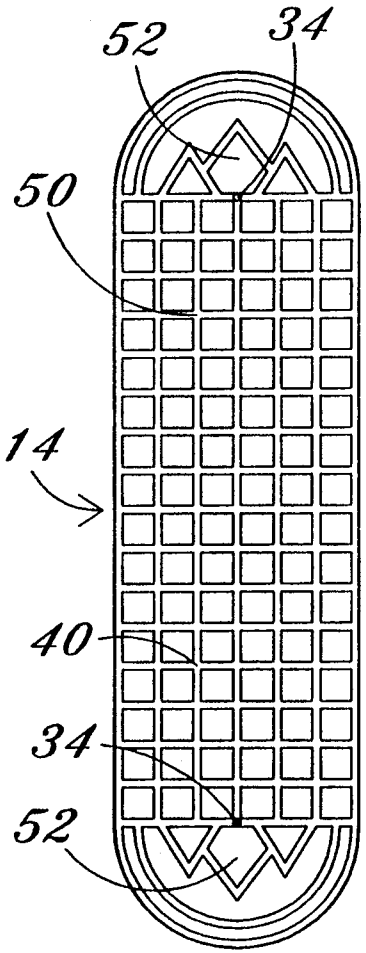
FIG. 2 is a top plan view of a typical non-slip pattern utilized on a padded strap, in accordance with the present invention.

The non-slip pattern 14, as is particularly illustrated in the top plan view of FIG. 2 and the cross-sectional views of FIGS. 3 and 4, provides a portion of the shoulder engaging surface 32 which will rest against the user's shoulder and prevent slippage. The material and arrangement of the non-slip pattern 14 acts to resist surface sliding and to act as a resilient cushion during usage while presenting no impediment to vertical lifting of the strap pad 12 from the user's shoulder.

As is especially shown in FIG. 4, the non-slip pattern 14 is embedded into and incorporated with the inner shell member 28 in such a manner as to provide an integral and permanent attachment. The non-slip pattern 14 is formed of a liquid silicone rubber ("LSR") material 38 which is formed into a elongated trapezoidal bar portion 40 and a surrounding 42 portion. The bar portion 40 is the portion of the LSR material 38 which extends beyond the shoulder engaging surface 32 and a plurality of arrayed bar portions 40 constitute the visible non-slip pattern 14.

As is shown in FIG. 4, the shoulder engaging surface 32 of the inner shell member 28 is seen to include a plurality of base fibers 44 which form a back plane 46. The velour "feel" is provided by upright fibers 48 extending normally to the back plane 46. The manner in which the LSR 38 is bonded to the inner shell member 28 is that the surrounding portion 42 is intertwined around the base fibers 44 which provide the back plane 46 of the inner shell member 28. The back plane 46 is the structural component of the inner shell member 28 while a series of upright fibers 48 provide cushion and feel to the shoulder engaging surface 32. It has been found that the velour fabric selected for the inner shell member 28 ideally mates with the LSR 38 to form a non-slip pattern 14 on the shoulder engaging surface 32.

As is seen particular in FIGS. 1 and 2, the bar portion 40 of the LSR 38 may be molded into the non-slip pattern 14 in a variety of shapes. The preferred non-slip pattern 14 as shown in FIGS. 2 and 3, includes a grid portion 50, having a series of bar portion arrayed so as to cross and intersect. Since the entire pattern 14 is integrally formed, there is no difference in the structure of the LSR material 38 at the material junctions from other areas of the bar portion 40. As is seen in FIG. 3, the bar portion 40 extends upward from the back plane 46 to a height approximately equal to that of the uncompressed upright fibers 48. It is also noted that the upright fibers 48 in the vicinity of the bar portion 40 are compressed by the molding process so that the trapezoidal bar portion 40 actually extends directly from the base plane rather than from the surface of the upright fibers 48.

The cross grid pattern 50 is specifically selected to provide a maximum resistance to surface sliding of the non-slip pattern 14 on the user shoulder. The trapezoidal cross-sectional shape of the bar portion 40 (see FIGS. 3 and 4) provides apexes which engage clothing, skin or other surface materials and inhibit slippage perpendicular to the long axis of the bar portions 40. Since some of the bar portions 40 are longitudinally arrayed, these will prevent slippage off the shoulder in a lateral direction. The remaining bar portions 40 are arrayed at a 90° angle and thus prevent forward and backward slippage of the non-slip carrying strap 10.

In illustrations of FIGS. 1 and 2, the grid portion 50 is augmented at either end by a logo portion 52. This is a decorative illustration which may be created with the LSR material 38 and, in the preferred embodiment, forms the logo trademark of Sun Mountain Sports, Inc. The logo portion 52 exemplifies the flexibility of the use of the embedded LSR material 38 in forming the non-slip pattern 14.

In the preferred embodiment the LSR 38 is selected to be Dow Corning Silastic TM LSR 595. This LSR material 38 is selected for durability, high tensile and tear strength and substantial flexlife. The LSR material 38 is a self-leveling translucent poster like material. Although other selections of LSR material 38 may be appropriate, it has been found that the preferred LSR material 38 exhibits an excellent mix of properties desirable for a golf bag strap. In particular, it is noted that this selection avoid any bleeding of the material to unwanted areas, is not subject to ultraviolet breakdown, is available in a wide variety of colors, in order to match the bag strap desired, and is extremely long lasting.

The application of the non-slip pattern 14 to the inner shell member 28 is readily accomplished with the proper equipment and materials. Initially, it is necessary to prepare a mold plate having the non-slip pattern 14 shape formed therein. Since the shrinkage of the preferred LSR material 38 is relatively low (approximately 3%) the dimensions of the mold indentation need only be very slightly greater than the desired dimensions of the non-slip pattern 14. It has been found that it is appropriate to form the bar portions 40 to have a height approximately equal to the uncompressed height of the upright fibers 48 of the selected velour or similar material. In the case of the velour material utilized for the inner shell member 28 in the preferred embodiment, the height of the desired bar portion 40 is selected to be 0.015 cm (0.0060 in). Furthermore, the trapezoidal bar portions 40 are selected to have a base width of approximately 0.030 cm (0.012 in).

Once the mold plate has been prepared it is utilized in conjunction with a heat press injection molding apparatus. The LSR material 38 is package as two separate components which are mixed shortly prior to utilization. The mixture is then caused to flow into the mold plate so as to fill the mold depressions and to bulge very slightly above the mold plate. An inner shell member 28 is then placed within the apparatus with the shoulder engaging surface 32 abutting against the inner surface of the mold plate. The molding apparatus is then closed with pressure and heat being applied to the inner shell member 28 and the mold plate. In the preferred embodiment it has been found that approximately ten tons of pressure at a temperature of approximately 200° C. for twenty to thirty seconds provide an adequate amount of curing to the LSR material 38. This also minimizes the amount of heat delivered to the mold plate such that a short cool time is required before reuse, thus maximizing manufacturing throughout. The molded bag strap material is ready for use nearly immediately.

Although the present invention has been described above in terms of specific materials and dimensions, it is understood that various other materials and dimensions may be substituted without departing from the efficacy of the invention. Furthermore, although the preferred embodiment has been described with respect to a carrying strap for a golf bag it is understood that the principles of the present invention are equally applicable for a wide variety of other applications. In particularly, shoulder straps for back packs are specifically envisioned, as are carrying straps for such other applications as ski bags and tennis bags, and other applications where it is desirable to utilized a cushioned non-slip strap in conjunction with normally slippery surfaces such as clothing materials.

Various other modifications and alterations of the dimensions, materials, orientation and usages may be made without departing from the invention. Those skilled in the art will readily recognize additional embodiments and utilization. Accordingly, the above disclosure is not to be considered as limiting and the appended claims are to be interpreted as encompassing the entire spirit and scope of the invention.

INDUSTRIAL APPLICABILITY

The non-slip carrying strap 10 according to the preferred embodiment of the present invention is directly applicable to existing golf bags. The bag straps of modern golf bags are generally selected to be interchangeable both at the time of manufacturer and at later times. Accordingly, a non-slip carrying strap 10 according to the present invention, once manufactured, could be incorporated into any of other wide variety of existing golf bags. In particular, the non-slip carrying strap 10 is adapted specifically fór incorporation into the Eclipse TM golf bags and other golf bag products of Sun Mountain Sports, Inc. of Missoula, Mont.

The usage of the bag strap of the present invention is straight forward and will be readily apparent to anyone in the golf industry.

In light of the above described aspects and advantages of the present invention, it is expected that the non-slip carrying strap 10 will be desirable for usage both as a original equipment and as a after market replacement for warned bag straps. Accordingly, it is expected that the present invention will enjoy immediate, long lasting and wide spread industrial applicability and commercial utility.

I claim:

1. A sliding friction enhancing surface for a golf bag strap for inhibiting slippage between the surface of the strap and a human shoulder, comprising:

a fabric material enclosing cushioning material, the fabric material having low resistance to sliding friction and having a structural backplane including distinguishable fibers;

a non-slip pattern in the nature of and open array of flexible rubber-like material formed on the fabric material in such a manner that the rubber-like material encompasses a portion of said fibers.

2. The sliding friction enhancing surface of claim 1 wherein the non-slip pattern includes a plurality of bar portions extending along and above the local surface of said fabric material, at least a first group of said bar portions being arrayed effectively perpendicularly to a second group of said bar portions.

3. The sliding friction enhancing surface of claim 2 wherein said bar portions are generally trapezoidal in cross-sectional shape with the wider base of said trapezoid encompassing said fibers.

4. The sliding friction enhancing surface of claim 1 wherein said rubber-like material is a Liquid Silicone Rubber ("LSR")selected for durability.

5. The sliding friction enhancing surface of claim 4 wherein said LSR is Dow-Corning Silastic LSR 595.

6. The sliding friction enhancing surface of claim 1 wherein the fabric material is velour.

7. The sliding friction enhancing surface of claim 1 wherein the non-slip pattern includes apexes formed on said rubber-like material such that said apexes enhance resistance to sliding motion between the friction enhancing surface and the load supporting element 8. In a carrying strap including a shoulder-engaging surface surrounding a cushioned material, the improvement comprising:

the shoulder-engaging surface is in the form of a cushioned fabric having backplane fibers and upright fibers;

open pattern of friction enhancing cushioning material is boned to the shoulder engaging surface in a manner which inhibits sliding motion between the carrying strap and the shoulder while permitting uninhibited lifting of the strap from the shoulder, the bonding of said open pattern on the engaging surface creating deformable ridges bordered by portions of the shoulder engaging surface to which no friction enhancing cushioning material is applied; wherein the pattern is bonded in such a manner that said cushioning material encompasses a portion of said backplane fibers so as to be permanently secured thereto.

9. The improvement of claim 8 wherein the pattern is in the form of an array of elongated bars of said cushioning material, some of said bars being oriented longitudinally and some of said bars being oriented laterally along said shoulder engaging surface such that sliding motion is inhibited in any direction.

10. The improvement of claim 9 wherein said elongated bars are formed to have a height from said backplane fibers approximately equal to the height of said upright fibers.

11. The improvement of claim 9 wherein the pattern is in the form of a rectangular array of squares bounded by said elongated bars.

12. The improvement of claim 8 wherein said cushioning material is dyed in such a manner as to esthetically complement the coloration of said shoulder engaging surface.

* * * * *